US011565285B2

(12) United States Patent
Liu et al.

(10) Patent No.: US 11,565,285 B2
(45) Date of Patent: Jan. 31, 2023

(54) SELF-CLEANING AUTOMATICALLY-STORED ELECTRICAL MOP

(71) Applicant: SHENZHEN JASHEN TECHNOLOGY CO., LTD., Shenzhen (CN)

(72) Inventors: Zhi-Chang Liu, Shenzhen (CN); Xiao-Ming Zhang, Shenzhen (CN); Jian-Xin Xi, Shenzhen (CN)

(73) Assignee: SHENZHEN JASHEN TECHNOLOGY CO., LTD., Shenzhen (CN)

( * ) Notice: Subject to any disclaimer, the term of this patent is extended or adjusted under 35 U.S.C. 154(b) by 624 days.

(21) Appl. No.: 16/560,503

(22) Filed: Sep. 4, 2019

(65) Prior Publication Data

US 2020/0406306 A1 Dec. 31, 2020

(30) Foreign Application Priority Data

Jun. 25, 2019 (CN) ..... 201910560001.4
Jun. 25, 2019 (CN) ..... 201910560059.9
(Continued)

(51) Int. Cl.
*A47L 11/292* (2006.01)
*A47L 13/22* (2006.01)
(Continued)

(52) U.S. Cl.
CPC ..... *B08B 3/041* (2013.01); *A47L 9/0063* (2013.01); *A47L 11/185* (2013.01); *A47L 11/292* (2013.01);
(Continued)

(58) Field of Classification Search
CPC .. A47L 11/185; A47L 11/292; A47L 11/4016; A47L 11/408; A47L 11/4083;
(Continued)

(56) References Cited

U.S. PATENT DOCUMENTS 4,875,246 A * 10/1989 MacGregor ..... A47L 13/144 15/98
6,463,616 B1 * 10/2002 Morokutti ..... A47L 11/292 15/83
(Continued)

FOREIGN PATENT DOCUMENTS

CN 205181256 U * 4/2016
CN 107007213 A * 8/2017

*Primary Examiner* — Randall E Chin
(74) *Attorney, Agent, or Firm* — Muncy, Geissler, Olds & Lowe, P.C.

(57) ABSTRACT

A self-cleaning automatically-stored electrical mop includes a mop rod assembly, a mop head assembly, and a cleaning base assembly used for storing and cleaning the mop head assembly. The mop head assembly is arranged at the lower end of the mop rod assembly and includes a mop head shell which is provided with a rotatable cleaning roller and a motor used for driving the cleaning roller. The cleaning base assembly includes a shell part. A cleaning groove used for cleaning the cleaning roller is formed in the shell part, and a cleaning assembly used for scrubbing the cleaning roller is arranged in the cleaning groove. The shell part is provided with a sewage discharge system used for discharging sewage.

12 Claims, 12 Drawing Sheets

(30) Foreign Application Priority Data

Jun. 26, 2019 (CN) ..... 201910564423.9
Jun. 26, 2019 (CN) ..... 201910565112.4
Jun. 26, 2019 (CN) ..... 201910566387.X

(51) Int. Cl.

| | |
|---|---|
| ***A47L 13/58*** | (2006.01) |
| ***B08B 1/00*** | (2006.01) |
| ***A47L 13/51*** | (2006.01) |
| ***A47L 11/40*** | (2006.01) |
| ***B08B 3/04*** | (2006.01) |
| ***B08B 1/02*** | (2006.01) |
| ***A47L 13/20*** | (2006.01) |
| ***A47L 13/50*** | (2006.01) |
| ***A47L 9/00*** | (2006.01) |
| ***A47L 13/24*** | (2006.01) |
| ***A47L 11/18*** | (2006.01) |

(52) U.S. Cl.
CPC ..... *A47L 11/408* (2013.01); *A47L 11/4016* (2013.01); *A47L 13/20* (2013.01); *A47L 13/22* (2013.01); *A47L 13/24* (2013.01); *A47L 13/50* (2013.01); *A47L 13/51* (2013.01); *A47L 13/58* (2013.01); *B08B 1/005* (2013.01); *B08B 1/007* (2013.01); *B08B 1/02* (2013.01); *A47L 11/18* (2013.01)

(58) Field of Classification Search
CPC ..... A47L 13/22; A47L 13/50; A47L 13/51; A47L 13/58; B08B 1/005; B08B 1/007
See application file for complete search history.

(56) References Cited

U.S. PATENT DOCUMENTS

| | | | | |
|---|---|---|---|---|
| 10,912,438 | B2 * | 2/2021 | Li | A47L 11/292 |
| 2018/0206685 | A1 * | 7/2018 | Li | A47L 9/0477 |
| 2019/0254495 | A1 * | 8/2019 | Zhang | A47L 11/24 |
| 2020/0253447 | A1 * | 8/2020 | Wang | A47L 11/4005 |

* cited by examiner

SELF-CLEANING AUTOMATICALLY-STORED ELECTRICAL MOP

BACKGROUND OF THE INVENTION

1. Technical Field

The invention relates to mops, in particular to a self-cleaning automatically-stored electrical mop.

2. Description of Related Art

Mops are common domestic cleaning tools and mainly comprise a mop rod to be held and a mop head used for cleaning. With the development of science, various more electrical and intelligent mops have come into being.

Existing mops provided with one bar-shaped mop rod are designed according to human body heights, and the whole mop rod is very long in general. Today, e-commerce is becoming more and more well-developed, while the long mop rod which inconvenient to package and transport may cause a high cost when transported due to its large size.

Direct cleaning of the mops depends on cleaning parts which are located on the mop heads and are made of cloth strips or sponge rollers according to different designs. In use, the existing mop heads have the shortcoming of manual cleaning of the mop heads and the cleaning parts after floor cleaning, which in turn leads to complex operation, stains to hands and inconvenient usage. Besides, the cleaning parts of the existing mops are fixed, and when one contact surface is stained due to floor mopping, the mops need to be turned upside down to continuously clean the floor by means of another clean surface, which leads to inconvenient operation.

BRIEF SUMMARY OF THE INVENTION

The objective of the invention is to solve the problems of complex operation and hand stains caused by manual cleaning of the cleaning parts of mops in the prior art by providing a self-cleaning automatically-stored electrical mop which adopts a rotatable roller used for cleaning the floor as a cleaning part of a mop head, uses a cleaning base assembly provided with a cleaning groove to clean the cleaning part of the mop head, and is able to realize self-cleaning by means of the rotation of the cleaning roller during cleaning, thereby avoiding inconvenience and pollution caused by manual cleaning; meanwhile, a cleaning assembly is arranged in the cleaning base assembly to assist in scrubbing and cleaning the roller, so that the cleaning effect is further improved, and the whole electrical mop is convenient to use and has a good effect.

To fulfill the above-mentioned objective, the invention provides a self-cleaning automatically-stored electrical mop which comprises a mop rod assembly, a mop head assembly, and a cleaning base assembly used for storing and cleaning the mop head assembly, wherein the mop head assembly is arranged at the lower end of the mop rod assembly and includes a mop head shell which is provided with a rotatable cleaning roller and a motor used for driving the cleaning roller; the cleaning base assembly includes a shell part; and a cleaning groove used for cleaning the cleaning roller is formed in the shell part, a cleaning assembly used for scrubbing the cleaning roller is arranged in the cleaning groove, and the shell part is provided with a sewage discharge system used for discharging sewage.

Preferably, the motor is connected to the cleaning roller through a transmission assembly; the transmission assembly includes a change gear set, a transmission belt, and a roller connector which are sequentially connected; the roller connector is rotatably arranged on the mop head shell; and the cleaning roller is assembled on the roller connector.

Preferably, the mop rod assembly includes at least two connecting sections which are detachably connected.

Preferably, the mop rod assembly includes three connecting sections, the three sections are respectively a handle assembly, an upper rod assembly, and a lower rod assembly which are sequentially and detachably connected, and the mop head assembly is detachably connected to the lower rod assembly.

Preferably, the handle assembly includes a handle shell, and an insertion section is formed at the lower end of the handle shell and is provided with an elastic arm connected to the upper rod assembly; the upper rod assembly includes an upper rod shell, wherein an upper insertion groove allowing the insertion section to be inserted therein is formed in one end of the upper rod shell, a clamping groove matched with the elastic arm is formed in the side wall of the upper insertion groove, and the upper rod shell is provided with a handle release button used for releasing the elastic arm; the handle release button includes a button cap and a button rod stretching into the clamping groove; the button cap penetrates through a wall plate of the upper rod shell, and a limit protrusion matched with the wall plate is arranged on the lower edge of the button cap; and the upper insertion groove is defined by an insertion groove wall plate, the clamping groove is formed in the internal wall of the insertion groove wall plate, the button rod is sleeved with a return spring, and the return spring has an end abutting against the button cap as well as an end abutting against the external surface of the insertion groove wall plate.

Preferably, an elastic piece having a concave surface as the clamping groove is embedded into the side wall of the insertion groove, and the handle release button includes a button cap and a button rod which extrudes the elastic piece to deform, so that the elastic arm is disengaged from the concave surface to be released.

Preferably, the upper rod assembly includes the upper rod shell, and the lower rod assembly includes a lower rod shell; and an insertion part inserted into the upper rod shell is formed at one end of the lower rod shell, a lower insertion groove allowing the insertion part to be inserted therein is correspondingly formed in one end of the upper rod shell, and a mop head insertion groove allowing the mop head shell to be inserted therein is formed in one end of the lower rod shell.

Preferably, the insertion part is fixed into the lower insertion groove through a bolt.

Preferably, a water pump used for discharging cleaning water is arranged on the mop head shell and has an output end connected to a nozzle arranged on the mop head shell, and the water outlet end of the nozzle stretches out of the mop head shell.

Preferably, a positioning slot used for storing the cleaning roller is formed in the cleaning groove.

Preferably, the bottom surface of the cleaning groove is oblique.

Preferably, the cleaning assembly includes a water-squeezing scraper strip arranged on the edge of the positioning slot.

A method for using the electrical mop comprises the following steps: 1, using the cleaning roller to clean the floor; 2, placing the mop head assembly into the cleaning groove after usage, and placing the cleaning roller into the positioning slot, wherein the cleaning roller is submerged in water in the cleaning groove; 3, starting the motor to drive the cleaning roller to rotate to be cleaned, and scrubbing the cleaning roller by the water-squeezing scraper strip at the same time; and 4, discharging sewage out of the cleaning groove.

Preferably, the water pump is started to spray water or cleaning solutions to the floor to be cleaned before step 1.

The detailed structures or characteristics of the invention will be explained in the detailed description of the invention. However, those skilled in this field should appreciate that the detailed description and specific embodiments illustrated are only used for explaining the invention, and are not intend to limit the protection scope of the claims of the invention.

DETAILED DESCRIPTION OF THE INVENTION

The technical contents and characteristics of the invention are expounded as follows with reference to preferred embodiments and the accompanying drawings. The invention is mainly applied to electrical mops and wet-type electrical mops. Those skilled in this field would appreciate that descriptive terms in this embodiment are generic descriptions having no limitation on the application field. For instance, material or shape terms include, but are not limited to, materials or shapes specified in the description, and positional terms include, but are not limited to, "arrange", "near", "connect", and "abut". The number term "one", which indicates the number of assemblies, indicates one or more assemblies included. Directional terms such as "upper", "lower", "internal", "external", "top", and "bottom" in the specification are only illustrative ones based on the normal using direction, and are not intended to limit the scope claimed by the invention.

Figure 1:
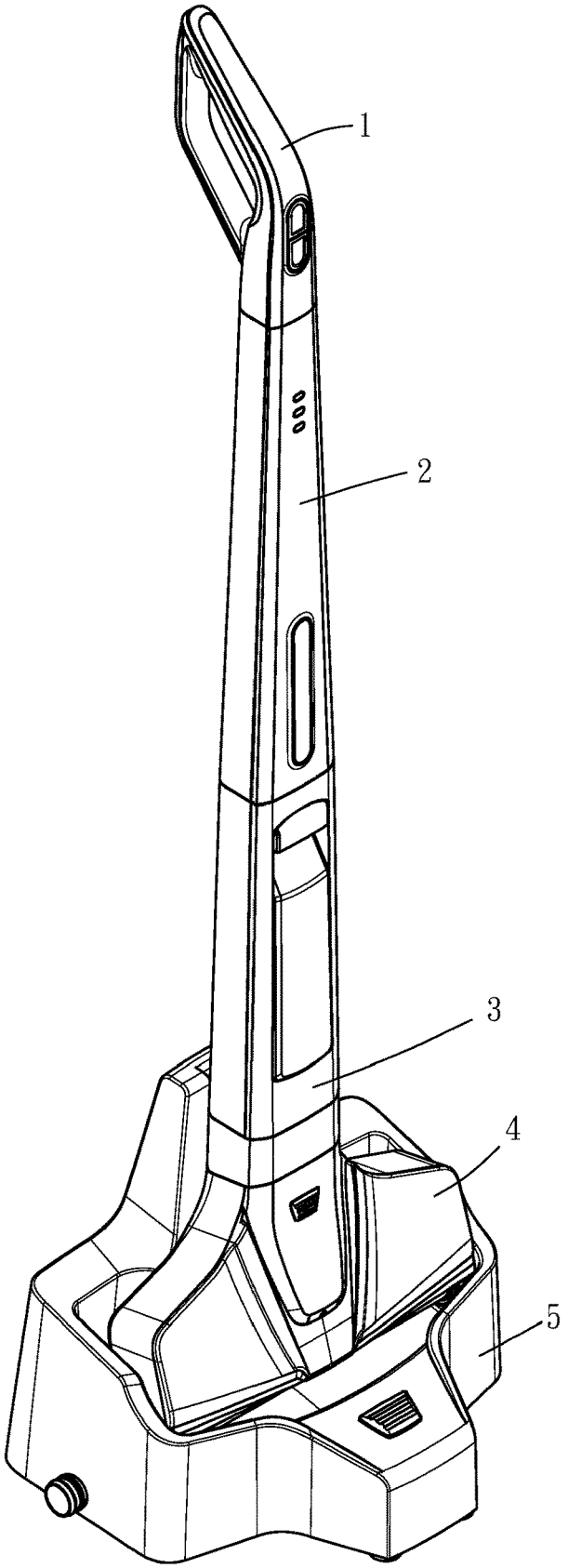
FIG. 1 is an assembled perspective view of a preferred embodiment of the invention.
Figure 2:
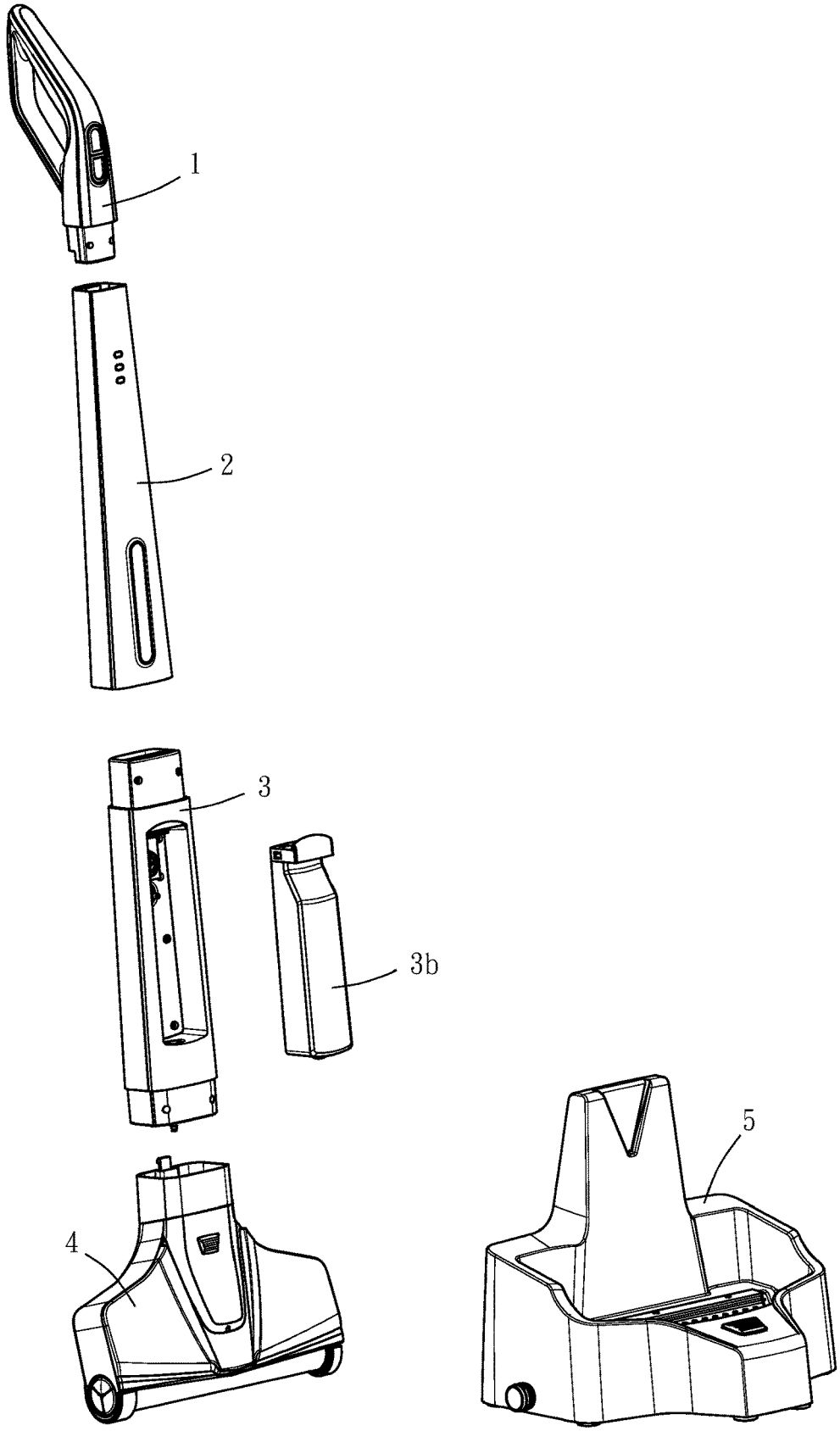
FIG. 2 is an exploded perspective view of the preferred embodiment of the invention.

As shown in FIG. 1 and FIG. 2, a self-cleaning automatically-stored electrical mop comprises a mop rod assembly, a mop head assembly 4, and a cleaning base assembly 5, wherein the mop rod assembly is provided with a handle assembly 1, an upper rod assembly 2, and a lower rod assembly 3, the mop head assembly 4 is arranged at the lower end of the mop rod assembly, and the cleaning base assembly 5 is used for storing and cleaning the mop head assembly 4. The mop rod assembly includes at least two connecting sections which are detachably connected.

In order to reduce the overall package size to facilitate packaging and transportation, the mop rod assembly is formed by a plurality of detachable sections, and the number of the sections is determined according to the design. As a preferred solution, the mop rod assembly in this embodiment includes three connecting sections which are respectively the handle assembly 1, the upper rod assembly 2, and the lower rod assembly 3 which are sequentially and detachably connected, and the mop head assembly 4 is detachably connected to the lower rod assembly 3.

Figure 3:
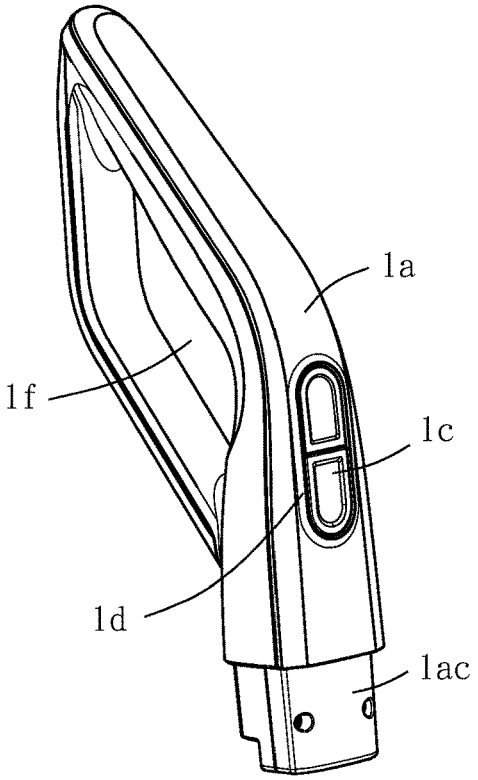
FIG. 3 is a partial perspective view of the preferred embodiment of the invention, mainly showing a handle assembly of a mop rod.
Figure 4:
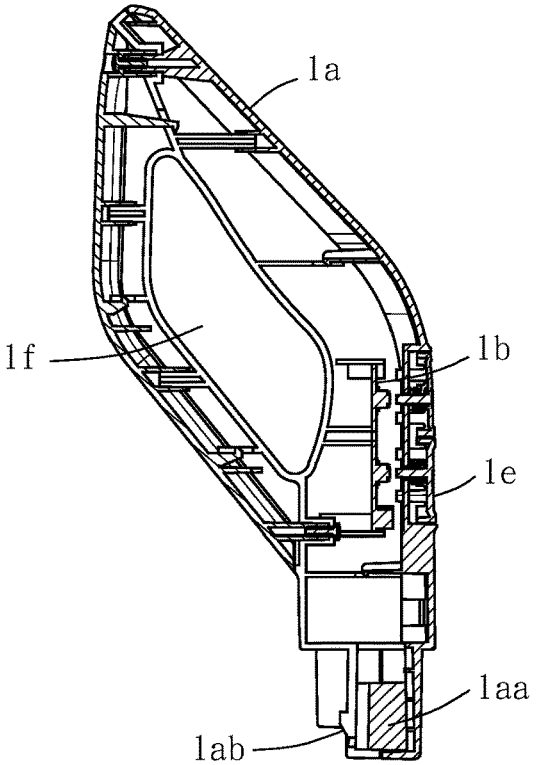
FIG. 4 is a partial sectional view of the preferred embodiment of the invention, mainly showing the handle assembly of the mop rod.

As shown in FIG. 3 and FIG. 4, the handle assembly 1 is provided with a hollow handle shell 1*a*, a tubular insertion section 1*aa* is formed at the lower end of the handle shell 1*a*, the inside of the handle shell 1*a* is communicated with the outside through the insertion section 1*aa*, an elastic arm 1*ab* used for connection and clamping is formed on the insertion section 1*aa*, and a protrusion used for connection and clamping is formed on the external surface of the elastic arm 1*ab*. Preferably, a switch circuit board 1*b* is arranged in the handle shell 1*a*, and correspondingly, the handle shell 1*a* is provided with switch buttons 1*c*. Preferably, a switch button hole is formed in a position, where the switch buttons 1*c* are to be arranged, of the handle shell 1*a*, a button board 1*d* is arranged at the switch button hole, and the switch buttons 1*c* are arranged on the button board 1*d* and inwards penetrate through the button board 1*d* to stretch into the handle shell 1*a*. Preferably, the button board 1*d* is buckled on the edge of the switch button hole through a buckling structure. Preferably, a button return spring 1*e* is arranged between the switch buttons 1*c* and the button board 1*d*. Preferably, the switch buttons 1*c* include a motor button and a water pump button. Preferably, the handle shell 1*a* is bent to form a handle ring if to be held.

The specific structure of the handle assembly is given in this embodiment, wherein the handle shell 1*a* is used as a main part, and related accessories such as the switch circuit board 1*b* are arranged in the hollow handle shell 1*a*. The insertion section 1*aa* is inserted into the upper rod assembly 2 and is buckled through the protrusion on the elastic arm 1*ab*. The switch circuit board 1*b* constitutes one part of a switch circuit and fulfills on-off control in cooperation with the switch buttons 1*c*. The switch buttons 1*c* are specifically configured through the button board 1*d*. The button board 1*d* is buckled on the edge of the switch button hole, thereby being convenient to assemble and disassemble. The button return spring 1*e* allows the switch buttons 1*c* to be pressed to return, and when an external force for pressing disappears, the switch buttons 1*c* return under the action of the button return spring 1*e*. In this solution, the switches are mainly used for controlling a motor and a water pump, and accordingly, the motor button and the water pump button are configured. The handle ring if is configured to be conveniently held by users.

Figure 5:
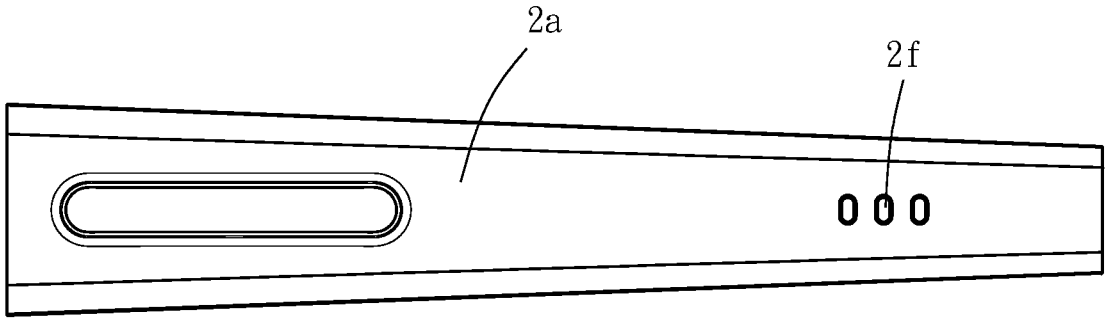
FIG. 5 is a partial front view of the preferred embodiment of the invention, mainly showing the internal structure of an upper rod assembly of the mop rod.
Figure 6:
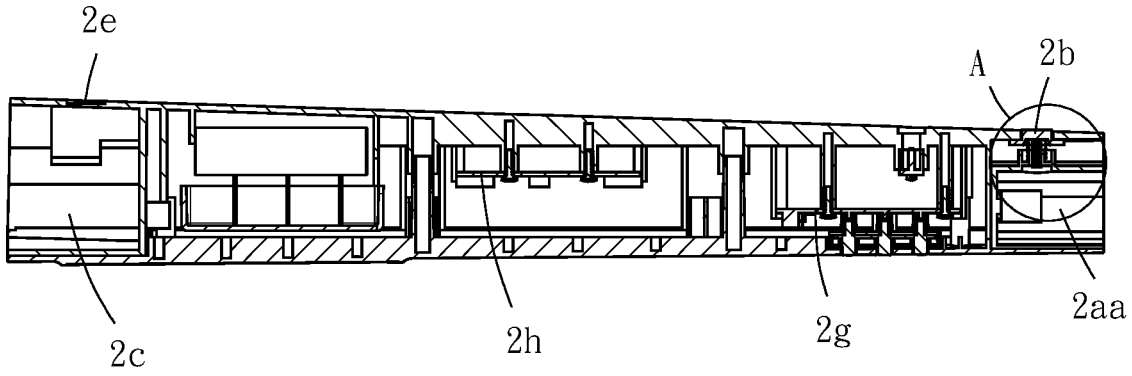
FIG. 6 is a partial sectional view of the preferred embodiment of the invention, mainly showing the internal structure of the upper rod assembly of the mop rod.
Figure 7:
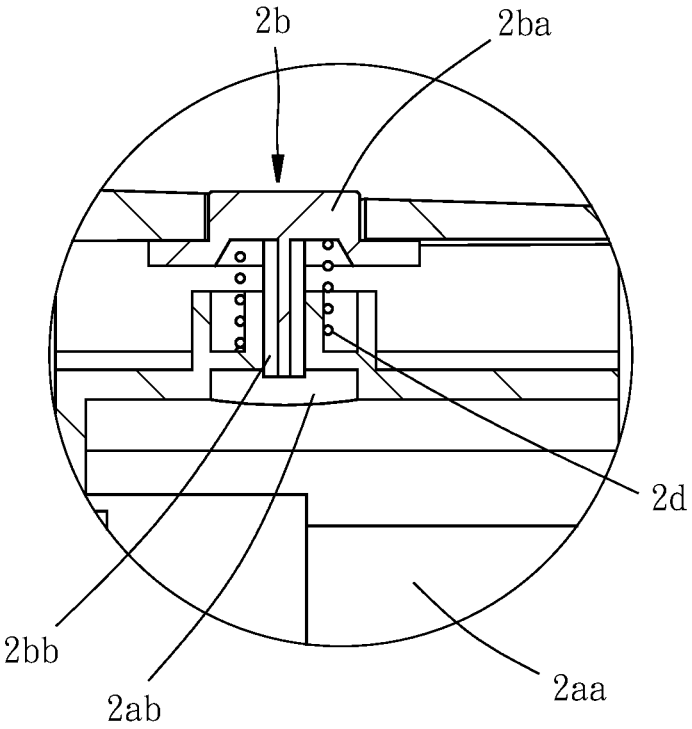
FIG. 7 is an enlarged view of part A in FIG. 6.

As shown in FIG. 5, FIG. 6, and FIG. 7, the upper rod assembly 2 is provided with an upper rod shell 2*a*, an upper insertion groove 2*aa* allowing the handle assembly 1 to be inserted therein is formed in one end of the upper rod shell 2*a*, a clamping groove 2*ab* matched with the elastic arm 1*ab* is formed in the side wall of the upper insertion groove 2*aa*, and a handle release button 2*b* used for releasing the elastic arm 1*ab* is arranged on the upper rod shell 2*a* and has an end stretching into the clamping groove 2*ab*; and a lower insertion groove 2*c* allowing the lower rod assembly 3 to be inserted therein is formed in the other end of the upper rod shell 2*a*. Preferably, the handle release button 2*b* includes a button cap 2*ba* and a button rod 2*bb* stretching into the clamping groove 2*ab*. Preferably, the button cap 2*ba* penetrates through a wall plate of the upper rod shell 2*a*, and a limit protrusion matched with the internal surface of the wall plate is arranged on the lower edge of the button cap 2*ba*. Preferably, the upper insertion groove 2*aa* is defined by an insertion groove wall plate, the clamping groove 2*ab* is formed in the internal wall of the insertion groove wall plate, the button rod 2*bb* is sleeved with a return spring 2*d*, and the return spring 2*d* has an end abutting against the button cap 2*ba* as well as an end abutting against the external surface of the insertion groove wall plate. Preferably, a first bolt hole 2*e* used for fixing the lower rod assembly 3 is formed in the upper rod shell 2*a* and extends into the lower insertion groove 2*c*. Preferably, the upper rod shell 2*a* is provided with an indicator light 2*f*, and an indicator light panel 2*g* connected with the indicator light 2*f* is arranged in the upper rod shell 2*a*. Preferably, a main control panel 2*h* is arranged in the upper rod shell 2*a*.

The specific structure of the upper rod assembly 2 is given in this embodiment, wherein the upper rod shell 2*a* is used as a main part of the upper rod assembly 2 and has an upper end connected with the handle assembly 1 and a lower end connected with the lower rod assembly 3, and specifically, the upper rod shell 2*a* is connected with the insertion section 1*aa* on the handle shell 1*a* in an insertion manner through the upper insertion groove 2*aa* and is clamped in the clamping groove 2*ab* through the elastic arm 1*ab*. The protrusion on the elastic arm 1*ab* is clamped in the clamping groove 2*ab*. When the upper rod assembly 2 needs to be released, the handle release button 2*b* is pressed to move the button rod 2*bb* to extrude the elastic arm 1*ab* out of the clamping groove 2*ab*, and then the handle assembly 1 is pulled out. The handle release button 2*b* is pressed downwards for use and is pressed through the return spring 2*d* to return. In order to prevent the handle release button 2*b* from being pushed out by the return spring 2*d* and from being dropped from the upper rod shell 2*a*, the limit protrusion is arranged on the edge of the button cap 2*ba* to limit the wall plate of the upper rod shell 2*a* to fulfill anti-disengagement effect. In view of the electrical-control design of the mop, the indicator light 2*f* is adopted to display an electrical control state and is arranged on the upper rod shell 2*a* so as to be conveniently observed by users, and the corresponding indicator light panel 2*g* is arranged in the upper rod shell 2*a* to be matched with the indicator light 2*f* on circuit configuration. Similarly, on the basis of the electrical-control design of the mop, the main control panel 2*h* is arranged in the upper rod shell 2*a* to facilitate circuit configuration.

Figure 8:
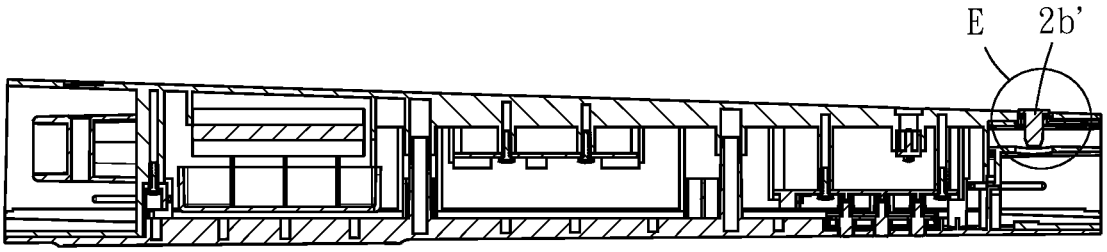
FIG. 8 is partial front view of the preferred embodiment of the invention, mainly showing the configuration of a handle release button.
Figure 9:
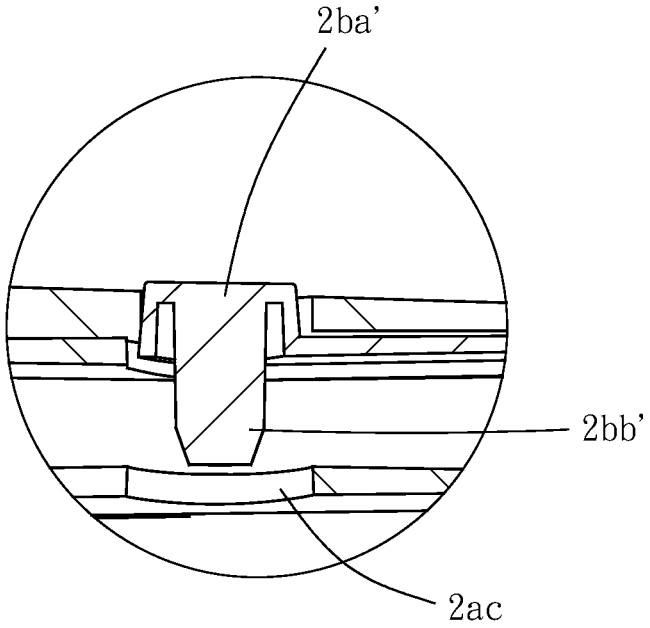
FIG. 9 is an enlarged view of part E in FIG. 8.

To reduce costs and to simplify the structure, as shown in FIG. 8 and FIG. 9, a handle release button 2*b*' in another structural form is given. An elastic piece 2*ac* having a concave surface as the clamping groove 2*ab* is embedded into the side wall of the insertion groove 2*aa*, and the handle release button 2*b*' includes a button cap 2*ba*' and a button rod 2*bb*' which extrudes the elastic piece 2*ac* to deform so that the elastic arm 1*ab* is disengaged from the concave surface to be released. The protrusion on the elastic arm 1*ab* is clamped in the concave surface of the elastic piece 2*ac* to form a fixed connection structure. The elastic piece 2*ac* enables the handle release button 2*b*' to return through the elasticity of its own, and particularly, the elastic piece 2*ac* is made from a disc spring or a similar elastic structure. During specific use, the button rod 2*bb*' extrudes the elastic piece 2*ac* under an external force, and then the protrusion on the elastic arm 1*ab* slides out of the concave surface, so that the elastic arm 1*ab* and the concave surface are separated. During implementations, the elastic piece 2*ac* can be made from various materials such as rubber as long as the materials can facilitate return of the button rod 2*bb*'. The concave surface is fixedly matched with the elastic arm 1*ab* and is a fixed concave surface of the elastic piece 2*ac* or a concave surface formed by extrusion of the elastic arm 1*ab*.

Figure 10:
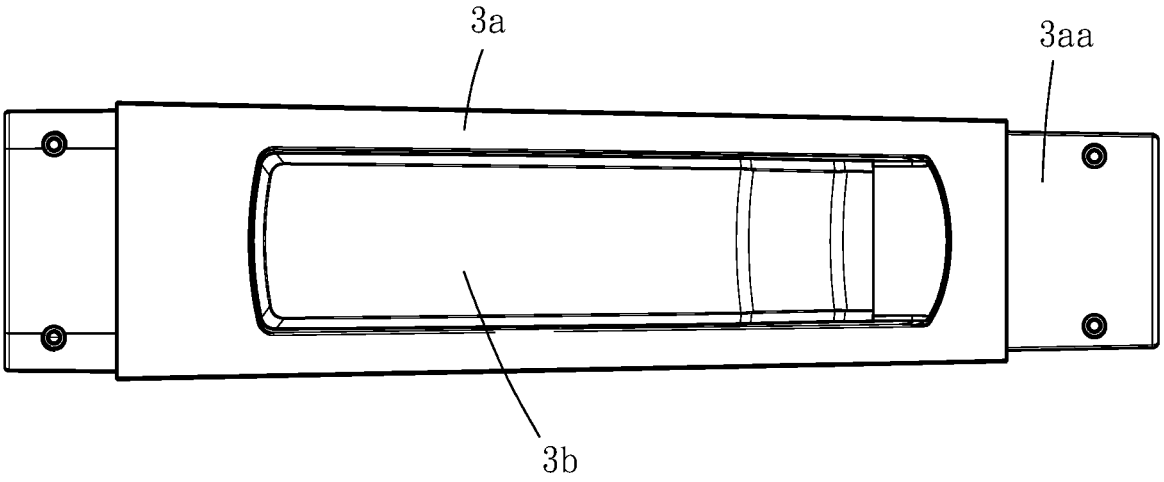
FIG. 10 is partial front view of the preferred embodiment of the invention, mainly showing the structure of a lower rod assembly of the mop rod.
Figure 11:
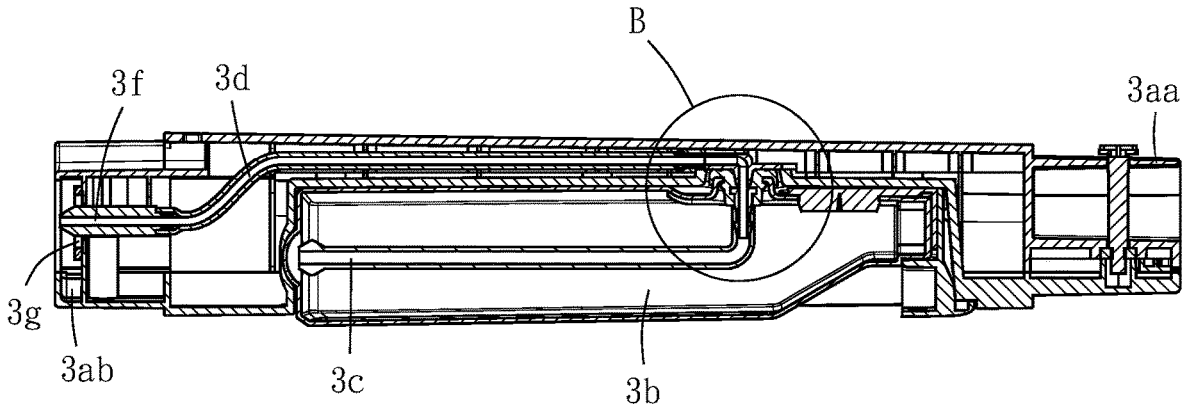
FIG. 11 is a partial sectional view of the preferred embodiment of the invention, mainly showing the internal structure of the lower rod assembly of the mop rod.
Figure 12:
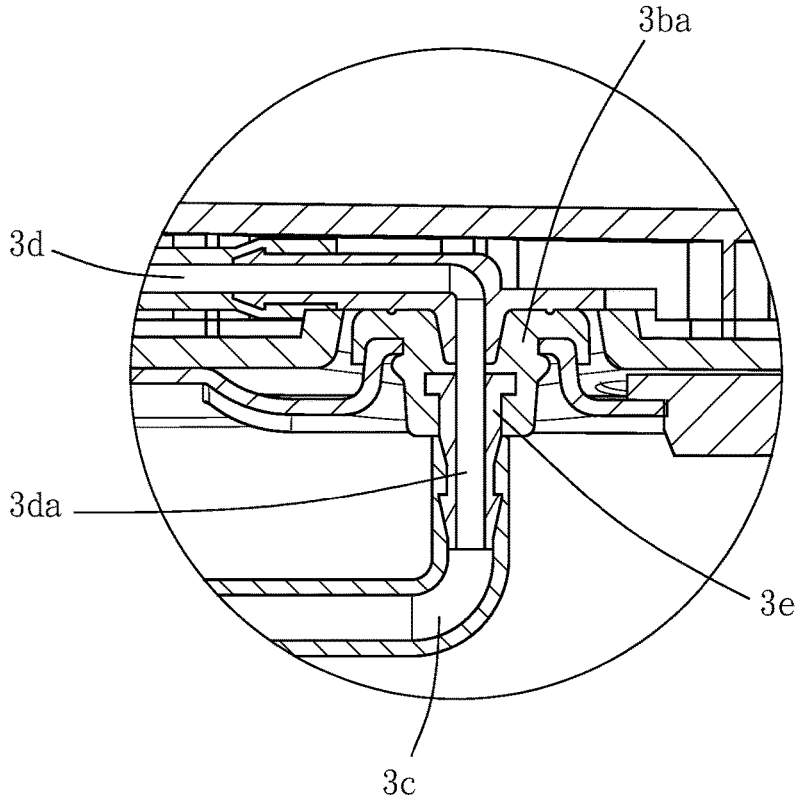
FIG. 12 is an enlarged view of part B in FIG. 11.

As shown in FIG. 10, FIG. 11, and FIG. 12, the lower rod assembly 3 is provided with a lower rod shell 3*a*, an insertion part 3*aa* inserted into the upper rod assembly 2 is formed at one end of the lower rod shell 3*a*, a mop head insertion groove 3*ab* allowing the mop head assembly 4 to be inserted therein is formed in the other end of the lower rod shell 3*a*, and the lower rod shell 3*a* is provided with a water tank 3*b*. Preferably, a second bolt hole used for fixing a bolt is formed in the insertion part 3*aa*. Preferably, a concave water tank bin is arranged on the lower rod shell 3*a*, and the water tank 3*b* is detachably arranged in the water tank bin. Preferably, a water-flow guide pipe 3*c* is arranged in the water tank 3*b* and has a lower end stretching to the bottom of the water tank 3*b* and an upper end connected to the side wall of the water tank 3*b* and extending out of the water tank 3*b*. Preferably, a main water pipe 3*d* is arranged in the lower rod shell 3*a* and has an upper end communicated with the water-flow guide pipe 3*c* and a lower end extending downwards out of the lower rod shell 3*a*. Preferably, a water pipe base 3*ba* is arranged on the side wall of the water tank 3*b*, a hole is formed in the water pipe base 3*ba*, the water-flow guide pipe 3*c* is fixed to the water pipe base 3*ba* and is communicated with the outside via the hole in the water pipe base 3*ba*. Preferably, a first rubber plug 3*e* provided with a flow-guide hole is embedded into the water pipe base 3*ba* and has an end stretching into the water-flow guide pipe 3*c* as well as an end fixed to the water pipe base 3*ba*, the flow-guide hole exactly faces the hole in the water pipe base 3*ba*, and correspondingly, a slim section 3*da* to be inserted into the flow-guide hole is formed at the upper end of the main water pipe 3*d*. Preferably, a second rubber plug 3*f* having a pipe arranged therein is arranged at the lower end of the main water pipe 3*d*, and the main water pipe 3*d* is communicated with the outside through the pipe arranged in the second rubber plug 3*f* Preferably, the second rubber plug 3*f* is fixed in the lower rod shell 3*a* through a fixed base plate 3*g*. Preferably, the water tank 3*b* is arranged in the water tank bin through a buckling structure.

In this embodiment, the lower rod shell 3*a* is used as a main part of the lower rod assembly 3, is inserted into the lower insertion groove 2*c* in the upper rod shell 2*a* through the insertion part 3*aa*, and is fixed through a bolt penetrating through the first bolt hole 2*e* and the second bolt hole. The lower rod shell 3*a* is connected with the mop head assembly 4 in an insertion manner through the mop head insertion groove 3*ab*. The water tank 3*b* contains water used for cleaning a mop head and is detachably arranged in the water tank bin through the buckling structure to facilitate water supply, water change and maintenance. The water tank 3*b* is kept smooth relative to the surface of the lower rod shell 3*a* through configuration of the water tank 3*b*. Water is discharged out of the water tank 3*b* via the water-flow guide pipe 3*c*; the lower end of the water-flow guide pipe 3*c* stretches to the bottom of the water tank 3*b*, so that water can be completely discharged; and the upper end of the water-flow guide pipe 3*c* stretches out of the water tank 3*b* and is connected with the main water pipe 3*d*, so that water can be discharged through the main water pipe 3*d*. Due to the fact that water tank 3*b* needs to be disassembled and taken out from the lower rod shell 3*a* and the water-flow guide pipe 3*c* is arranged in the water tank 3*b*, a connecting structure needs to be arranged between the water-flow guide pipe 3*c* and the main water pipe 3*d* to facilitate connection and communication. In view of this, the first rubber plug 3*e* provided with the flow-guide hole is arranged, and the first rubber plug 3*e* is communicated and connected with the water-flow guide pipe 3*c* and is fixed by the water pipe base 3*ba*. Meanwhile, in this structure, the slim section 3*da* to be inserted into the flow-guide hole is arranged on the main water pipe 3*d*, and when the main water pipe 3*d* is connected with the water-flow guide pipe 3*c*, the slim section 3*da* of the main water pipe 3*d* is inserted into the first rubber plug 3*e* to fulfill communication with the water-flow guide pipe 3*c*. When the water tank 3*b* needs to be taken down, the slim section 3*da* is pulled out of the first rubber plug 3*e*, and the first rubber plug 3*e* closes the hole through elasticity of its own so as to seal a pipe. Similarly, the second rubber plug 3*f* is arranged at the lower end of the main water pipe 3*d* and is fixed by the fixed base plate 3*g*, and in this case, the lower part of the whole main water pipe 3*d* is fixed. The fixed base plate 3*g* is of a combined structure formed by a plurality of plates and is used to fix the second rubber plug 3*f*.

Figure 13:
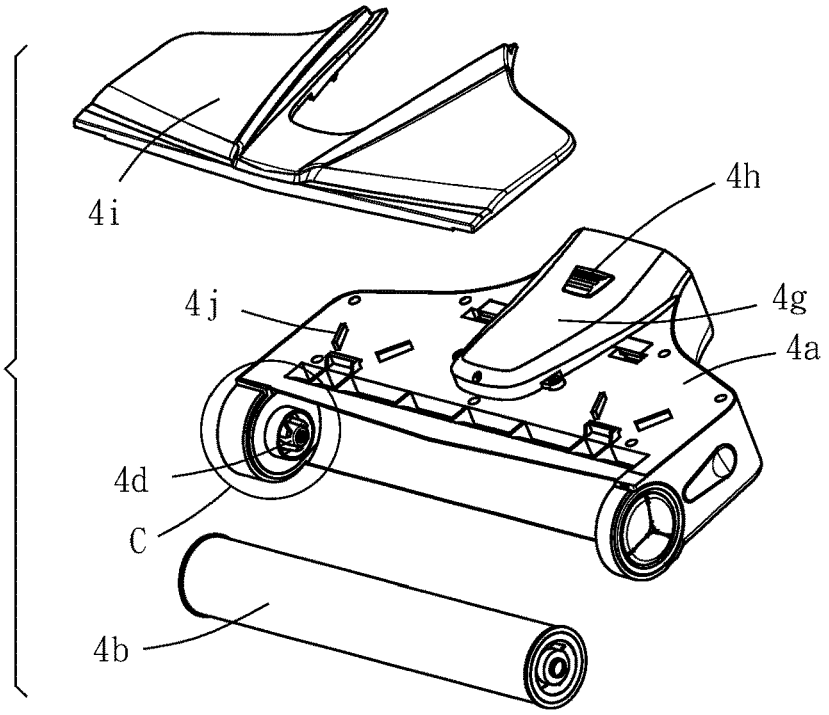
FIG. 13 is partial exploded perspective view of the preferred embodiment of the invention, mainly showing the exploded structure of a mop head assembly.
Figure 14:
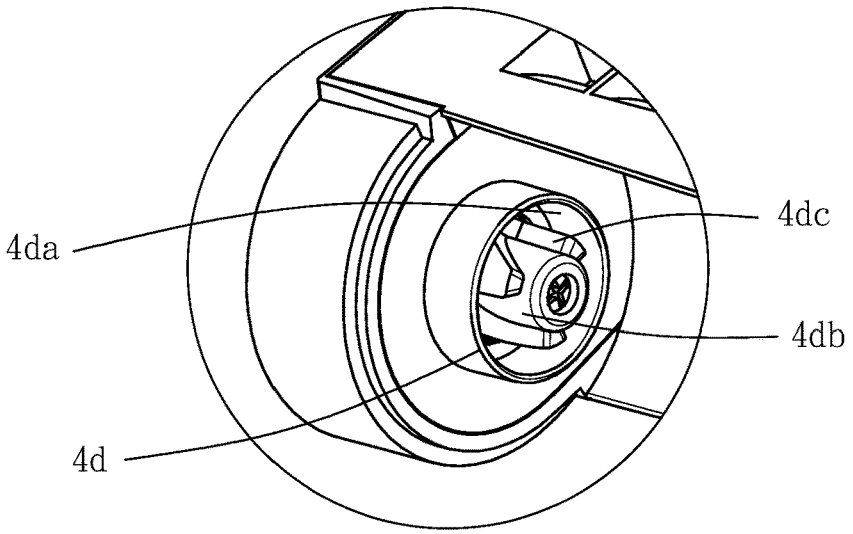
FIG. 14 is an enlarged view of part C in FIG. 13.
Figure 15:
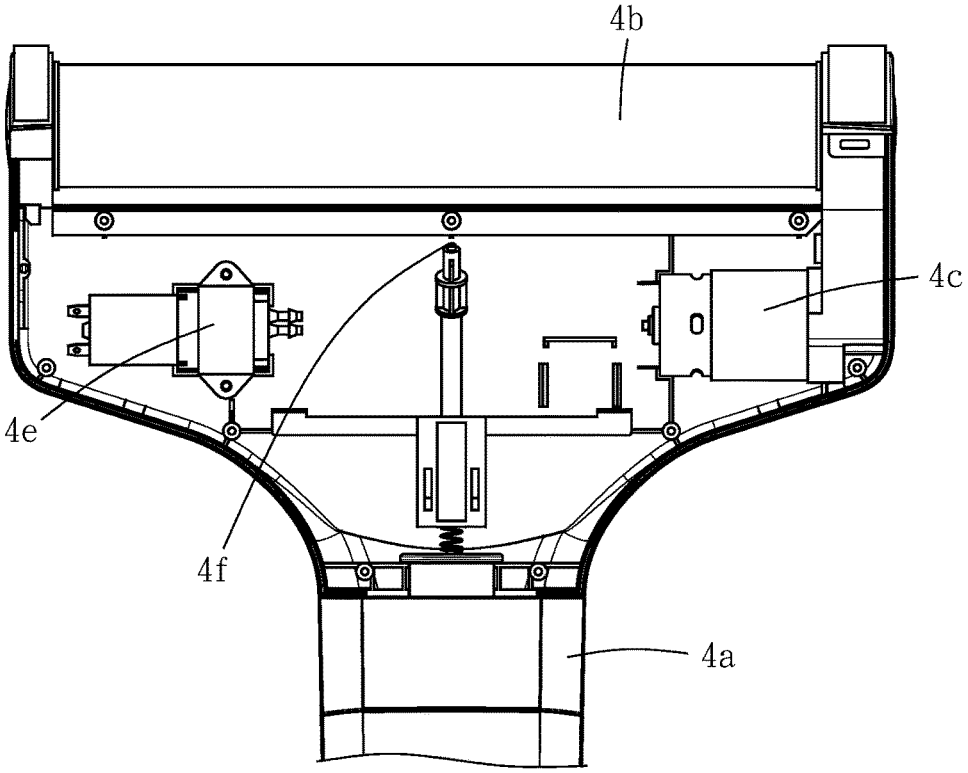
FIG. 15 is a partial sectional view of the preferred embodiment of the invention, mainly showing the internal structure of the mop head assembly.
Figure 16:
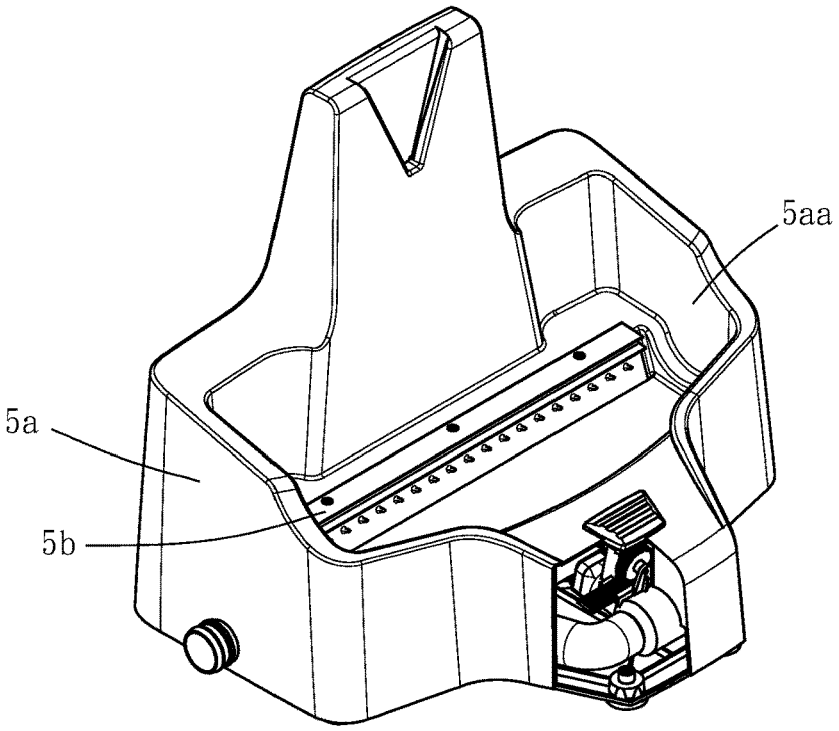
FIG. 16 is a schematic diagram of a cleaning base assembly in the preferred embodiment of the invention.
Figure 17:
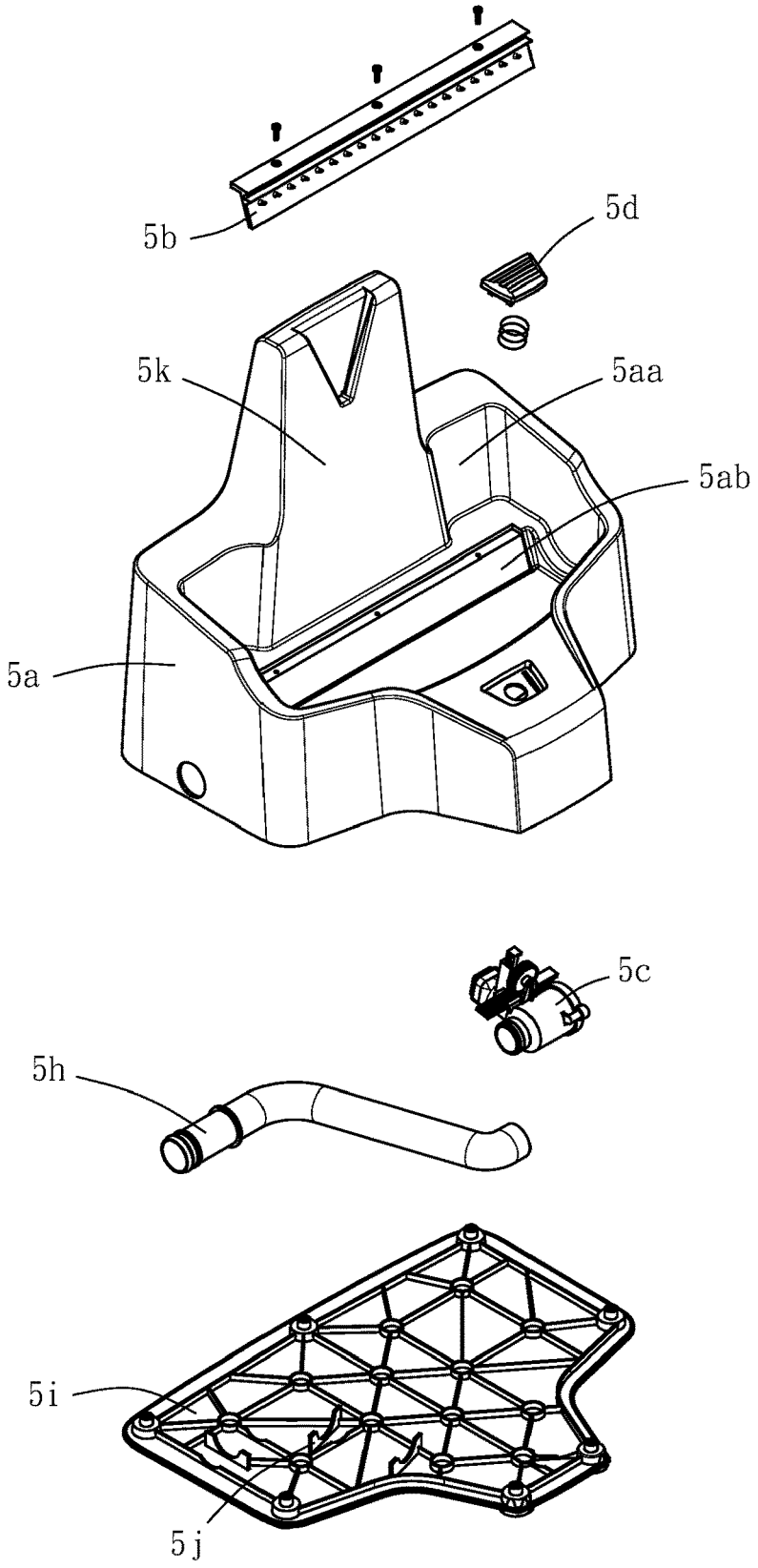
FIG. 17 is an exploded view of the cleaning base assembly in the preferred embodiment of the invention.
Figure 18:
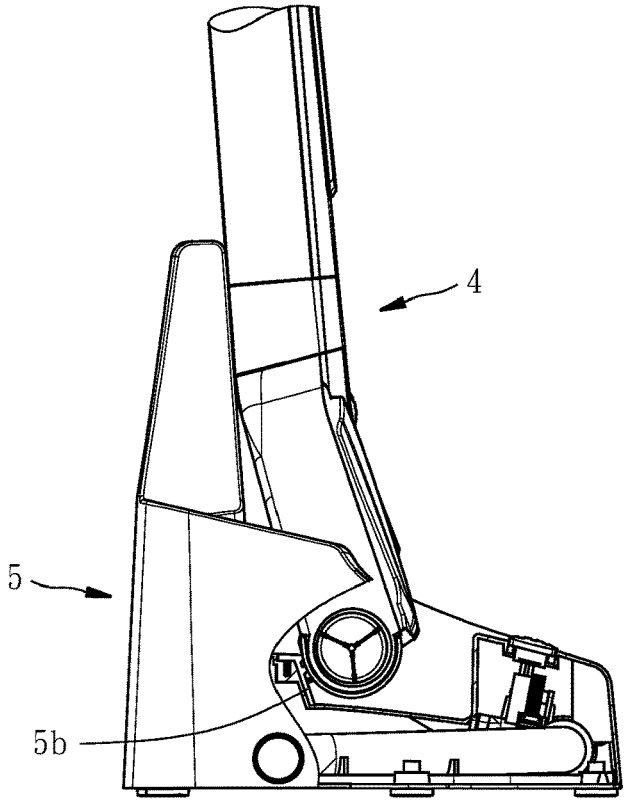
FIG. 18 is a schematic diagram for cooperative configuration of the cleaning base assembly and the mop head assembly in the preferred embodiment of the invention.
Figure 19:
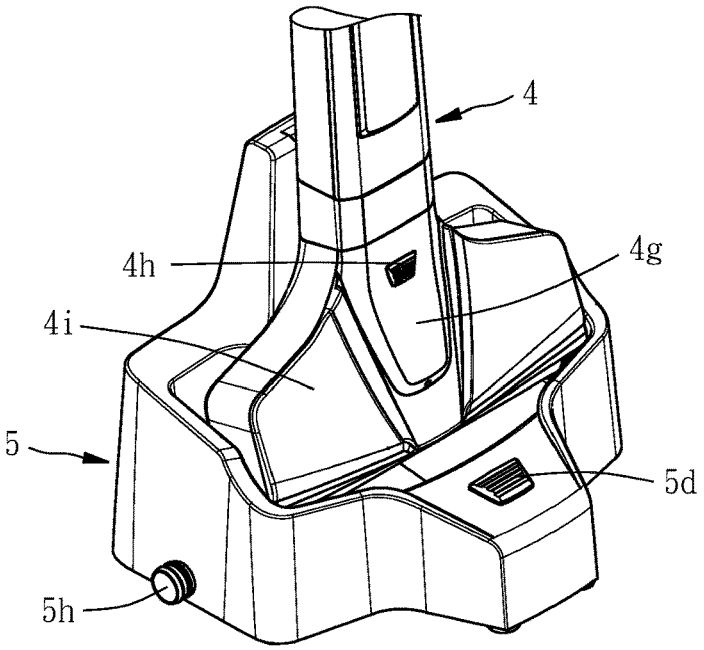
FIG. 19 is another schematic diagram for cooperative configuration of the cleaning base assembly and the mop head assembly in the preferred embodiment of the invention.

As shown in FIG. 13, FIG. 14, and FIG. 15, the mop head assembly 4 is provided with a mop head shell 4*a* which is provided with a rotatable cleaning roller 4*b*. Preferably, a motor 4*c* used for driving the cleaning roller 4*b* is arranged in the mop head shell 4*a* and is connected to the cleaning roller 4*b* through a transmission assembly. Preferably, the transmission assembly includes a change gear set, a transmission belt, and a roller connector 4*d*, wherein the motor 4*c*, the change gear set, the transmission belt, and the roller connector 4*d* are sequentially connected, and the cleaning roller 4*b* is assembled to the roller connector 4*d* rotatably arranged on the mop head shell 4*a*. Preferably, the roller connector 4*d* has an end correspondingly connected to a belt wheel of the transmission belt as well as an end provided with the cleaning roller 4*b* and is arranged on the mop head shell 4*a* through a bearing. Preferably, a cylindrical groove 4*da* is formed in the end, connected with the cleaning roller 4*b*, of the roller connector 4*d*, a cylinder core 4*db* used for assembling the cleaning roller 4*b* is arranged in the cylindrical groove 4*da*, and assembly protrusions 4*dc* are arranged on the external wall of the cylinder core 4*db*. Preferably, the number of the assembly protrusions 4*dc* is more than one, and the assembly protrusions 4*dc* are uniformly distributed on the external wall of the cylinder core 4*db* and are bent toward a circumferential edge of the cylinder core 4*db*. Preferably, a water pump 4*e* used for discharging cleaning water is arranged in the mop head shell 4*a* and has an output end connected to a nozzle 4*f*. Preferably, the nozzle 4*f* is arranged on the mop head shell 4*a* and has a water outlet end stretching out of the mop head shell 4*a*. Preferably, an opening extending into the mop head shell 4*a* is formed in the mop head shell 4*a*, and a surface cover plate 4*g* is arranged at the opening through a buckling structure and is provided with a button 4*h* used for unbuckling the buckling structure. Preferably, the mop head shell 4*a* is provided with a decoration panel 4*i* which is clamped on the mop head shell 4, and the decoration panel 4*i* and the surface cover plate 4*g* are integrally combined to cover the mop head shell 4*a*.

The structure of the mop head assembly 4 for a segmented mop rod is given in this embodiment. The mop head shell 4*a* is used as a main part and is provided with related parts such as the cleaning roller 4*b* and the motor 4*c*. The cleaning roller 4*b* rotates to clean the floor and rotates to fulfill self-cleaning as needed. Rotation power of the cleaning roller 4*b* is supplied by the motor 4*c*. The rotational speed of the motor 4*c* is high, while the cleaning roller 4*b* does not need to rotate at a high speed during work, so that the change gear set is adopted for speed reduction, and the change gear set belongs to the prior art and is not described anymore herein. Due to specific structural configuration of the parts, a certain distance exists between the motor 4*c* and the cleaning roller 4*b* driven by the motor 4*c* to rotate, in this case, the transmission belt is adopted to transmit the rotational speed, and two-stage transmission can be set according to the actual distance and transmission stability, that is to say, two transmission belts can be adopted to perform continuous transmission. The transmission belt belonging to the prior art includes the belt wheel driving the belt to move and is not described anymore herein.

The roller connector 4*d* is used for assembling the cleaning roller 4*b* and directly drives the cleaning roller 4*b* to rotate. To meet the rotation requirement of the roller connector 4*d*, the roller connector 4*d* is assembled through the bearing. The cleaning roller 4*b* is assembled through the cylindrical groove 4*da* and the cylinder core 4*db* and is assembled in the cylindrical groove 4*da* through a corresponding matching structure arranged at one end of the cleaning roller 4*b*, particularly, the cleaning roller 4*b* is inserted into the cylindrical groove 4*da* through the cylinder core 4*db*, and the assembly protrusions 4*dc* are arranged according to an engaged structural principle and can drive the cleaning roller 4*b* to rotate in structure. The edges of the assembly protrusions 4*dc* are bent to facilitate assembly and have a circumferential clamping effect while fulfilling axial moving assembly. The water pump 4*e* is used for pumping cleaning water, and particularly, the cleaning water discharged via the nozzle 4*f* arranged on the mop head shell 4*a* is directly sprayed to the cleaning roller 4*b* for cleaning. The surface cover plate 4*g* covers the opening of the mop head shell 4*a* to protect the inside of the mop head shell 4*a* against interference from the outside, and when the parts in the mop head shell 4*a* need to be handled, the buckling structure of the surface cover plate 4*g* is unbuckled through the button 4*h*. The button 4*h* is a provided with a spring, is able to return, and pushes the buckling structure to be unbuckled to be released when pressed downwards. The surface cover plate 4*g* is directly clamped on the buckling structure when assembled, and is then fixed through the buckling structure. The decoration panel 4*i* is used for covering the mop head shell 4*a* to fulfill decoration and coverage, and the decoration panel 4*i* is clamped to be assembled without screws, and after the decoration panel 4*i* is assembled in this way, no screw can be seen on the whole product in appearance. The specific clamping structure belongs to the prior art, and various other specific structures capable of assembling the decoration panel 4*i* on the mop head shell 4*a* can also be adopted. As shown in the figures, a convex rib 4*j* used for guiding is configured to fulfill blind assembly, and the decoration panel 4*i* can be accurately positioned by the convex rib 4*j* and is prevented from deviating so as to be conveniently and rapidly assembled.

As shown in FIG. 16 to FIG. 19, the cleaning base assembly 5 is provided with a shell part 5*a*, a cleaning groove 5*aa* is formed in the upper surface of the shell part 5*a*, a cleaning assembly used for scrubbing the mop is arranged in the cleaning groove 5*aa*, and the shell part 5*a* is provided with a sewage discharge system used for discharging sewage. Preferably, a positioning slot 5*ab* used for storing the mop head is formed in the cleaning groove 5*aa*. Preferably, the cleaning assembly includes a water-squeezing scraper strip 5*b* arranged on the edge of the positioning slot 5*ab*. Preferably, the sewage discharge system includes a sewage discharge valve 5*c* having a water inlet end connected into the cleaning groove 5*aa* as well as a water outlet end extending out of the shell part 5*a*, and the shell part 5*a* is provided with a button 5*d* used for opening the sewage discharge valve 5*c*.

The specific structure of the cleaning base assembly 5 is given in this embodiment. The shell part 5*a* is used as a main part of the cleaning base assembly 5, and the cleaning groove 5*aa* is used for containing water to clean the mop. The cleaning assembly is used for discharging sewage left on the roller of the mop. During implementations, the bottom surface of the cleaning groove 5*aa* is set to be oblique, so that the sewage in the cleaning groove 5*aa* can naturally flow out to be discharged. The shell part 5*a* is formed integrally, and as shown in the figures, the whole upper plate surface the shell part 5*a* is recessed downwards to form the cleaning groove 5*aa*, and correspondingly, the shell part 5*a* is integrally recessed to form the positioning slot 5*ab*. A main plate surface of the shell part 5*a* is bent to naturally form a cavity below the shell part 5*a* to configure related parts of the sewage discharge system. Moreover, a bottom shell plate 5*i* is arranged at the lower end of the shell part 5*a*, and the related parts of the sewage discharge system are sealed in the cavity to be protected. In order to realize firmer configuration of a sewage discharge pipe 5*h*, a fixing clamp plate 5*j* arranged to fix the sewage discharge pipe 5*h*. During the implementations, a plate of the shell part 5*a* integrally protrudes upwards to form a back part 5*k*, and the mop leans against the back part 5*k* to be stored more stably and firmly.

Figure 20:
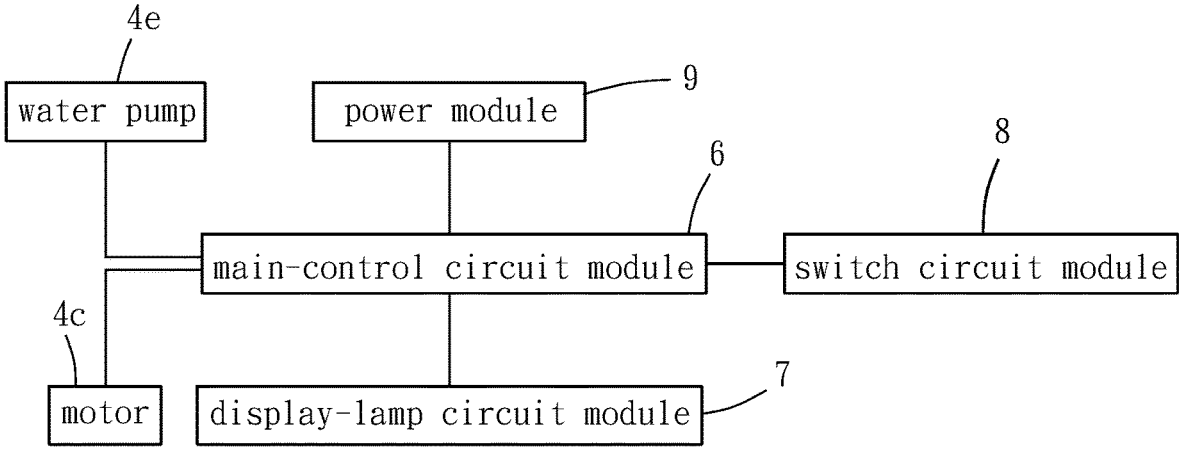
FIG. 20 is a schematic diagram of a circuit system in the preferred embodiment of the invention.

As shown in FIG. 20, a circuit system of a preferred embodiment of the invention includes a main-control circuit module 6, a display-lamp circuit module 7, a switch circuit module 8, a power module 9, a motor 4*c*, and a water pump 4*e*, wherein the main-control circuit module 6 is used for controlling the whole circuit system, the display-lamp circuit module 7 is used for configuring a display lamp, the switch circuit module 8 used for configuring a switch circuit of the motor 4*c* and the water pump 4*e*, the power module 9 is used for supplying power to the whole circuit system, the motor 4*c* is used for driving a cleaning roller 4*b* to rotate, the water pump 4*e* is used for pumping water to clean the cleaning roller 4*b*, and the display-lamp circuit module 7, the switch circuit module 8, the power module 9, the motor 4*c*, and the water pump 4*e* are connected to the main-control circuit module 6.

What is claimed is:

1. A self-cleaning automatically-stored electrical mop, comprising:

a mop rod assembly;

a mop head assembly arranged at a lower end of the mop rod assembly; and a cleaning base assembly used for storing and cleaning the mop head assembly, wherein the mop head assembly includes a mop head shell provided with a rotatable cleaning roller and a motor used for driving the cleaning roller, wherein the cleaning base assembly includes a shell part, wherein a cleaning groove used for cleaning the cleaning roller is formed in the shell part, a cleaning assembly used for scrubbing the cleaning roller is arranged in the cleaning groove, and the shell part is provided with a sewage discharge system used for discharging sewage, wherein the mop rod assembly includes three connecting sections, the three sections are respectively a handle assembly, an upper rod assembly, and a lower rod assembly which are sequentially and detachably connected, and the mop head assembly is detachably connected to the lower rod assembly, and wherein the handle assembly includes a handle shell, and an insertion section is formed at a lower end of the handle shell and is provided with an elastic arm connected to the upper rod assembly; the upper rod assembly includes an upper rod shell, an upper insertion groove allowing the insertion section to be inserted therein is formed in an end of the upper rod shell, a clamping groove matched with the elastic arm is formed in a side wall of the upper insertion groove, and the upper rod shell is provided with a handle release button used for releasing the elastic arm; the handle release button includes a button cap and a button rod stretching into the clamping groove; the button cap penetrates through a wall plate of the upper rod shell, and a limit protrusion matched with the wall plate is arranged on a lower edge of the button cap; and the upper insertion groove is defined by an insertion groove wall plate, the clamping groove is formed in an internal wall of the insertion groove wall plate, the button rod is sleeved with a return spring, and the return spring has an end abutting against the button cap as well as an end abutting against an external surface of the insertion groove wall plate.

2. The self-cleaning automatically-stored electrical mop according to claim 1, wherein the motor is connected to the cleaning roller through a transmission assembly, the transmission assembly includes a change gear set, a transmission belt, and a roller connector which are sequentially connected, the roller connector is rotatably arranged on the mop head shell, and the cleaning roller is assembled on the roller connector.

3. The self-cleaning automatically-stored electrical mop according to claim 1, wherein the mop rod assembly includes at least two connecting sections which are detachably connected.

4. The self-cleaning automatically-stored electrical mop according to claim 1, wherein an elastic piece having a concave surface as the clamping groove is embedded into a side wall of the insertion groove, and the button rod extrudes the elastic piece to deform, so that the elastic arm is disengaged from the concave surface to be released.

5. The self-cleaning automatically-stored electrical mop according to claim 4, wherein the upper rod assembly includes the upper rod shell, and the lower rod assembly includes a lower rod shell; and an insertion part inserted into the upper rod shell is formed at an end of the lower rod shell, a lower insertion groove allowing the insertion part to be inserted therein is correspondingly formed in an end of the upper rod shell, and a mop head insertion groove allowing the mop head shell to be inserted therein is formed in an end of the lower rod shell.

6. The self-cleaning automatically-stored electrical mop according to claim 5, wherein the insertion part is fixed in the lower insertion groove through a bolt.

7. The self-cleaning automatically-stored electrical mop according to claim 1, wherein a water pump used for discharging cleaning water is arranged on the mop head shell and has an output end connected to a nozzle arranged on the mop head shell, and a water outlet end of the nozzle stretches out of the mop head shell.

8. The self-cleaning automatically-stored electrical mop according to claim 1, wherein a positioning slot used for storing the cleaning roller is formed in the cleaning groove.

9. The self-cleaning automatically-stored electrical mop according to claim 1, wherein a bottom surface of the cleaning groove is oblique.

10. The self-cleaning automatically-stored electrical mop according to claim 9, wherein the cleaning assembly includes a water-squeezing scraper strip arranged on an edge of a positioning slot.

11. A method for using the electrical mop according to claim 10, comprising the following steps:

1, using the cleaning roller to clean a floor;

2, placing the mop head assembly into the cleaning groove after usage, and placing the cleaning roller into the positioning slot, wherein the cleaning roller is submerged in water in the cleaning groove;

3, starting the motor to drive the cleaning roller to rotate to be cleaned, and scrubbing the cleaning roller by the water-squeezing scraper strip at the same time; and 4, discharging sewage out of the cleaning groove.

12. The method for using the electrical mop according to claim 11, wherein a water pump is started to spray water or cleaning solutions to the floor to be cleaned before step 1.

* * * * *